United States Patent [19]

Roccaforte et al.

[11] 4,109,786

[45] Aug. 29, 1978

[54] CARTON FOR ROUND ARTICLES

[75] Inventors: Harry I. Roccaforte, Western Springs; William D. Pasquale, Downers Grove, both of Ill.

[73] Assignee: Champion International Corporation, Stamford, Conn.

[21] Appl. No.: 758,033

[22] Filed: Jan. 10, 1977

[51] Int. Cl.[2] ..... B65D 5/50

[52] U.S. Cl. ..... 206/45.14; 229/39 B

[58] Field of Search ..... 206/45.14, 45.19, 45.31; 229/39 B

[56] References Cited

U.S. PATENT DOCUMENTS

| | | | |
|---|---|---|---|
| 2,648,156 | 8/1953 | Colgate | 206/45.31 |
| 2,732,123 | 1/1956 | Bolding | 229/39 B |
| 3,135,384 | 6/1964 | Cozzolino | 206/460 |
| 3,204,759 | 9/1965 | Palmer | 206/45.31 |
| 3,374,884 | 3/1968 | Chinkes | 206/460 |
| 3,424,299 | 1/1969 | Rosenburg | 206/45.14 |
| 3,542,282 | 11/1970 | Troth | 229/38 |

FOREIGN PATENT DOCUMENTS

| | | | |
|---|---|---|---|
| 22,483 | 9/1930 | Netherlands | 229/39 B |

*Primary Examiner*—Herbert F. Ross
*Attorney, Agent, or Firm*—Evelyn M. Sommer

[57] ABSTRACT

A carton made of paperboard designed to contain and display round cylindrical articles and hold them in angular position to prevent slippage and rotation which would move the front of the cylindrical article out of registration with the display opening in the front of the carton. The invention may be in the form of a single blank which is folded to form a carton or a two piece blank and insert which folds the cylindrical article against an area covered with a substance such as hot melt adhesive or expanded polymer coating which is soft and provides a friction surface in contact with the cylindrical article.

3 Claims, 16 Drawing Figures

CARTON FOR ROUND ARTICLES

BACKGROUND OF THE INVENTION

1. Field of the Invention

This invention relates generally to display cartons and more particularly to those adapted to hold a smooth cylindrical article in position and prevent it from rotating to a position out of registration with the opening in the front of the display carton.

2. Description of the Prior Art

The various approaches to be found in the prior art to solve the present problem include placing the article in an insert which grips the article and is then placed within the carton such as seen in U.S. Pat. No. 2,325,224 to Bryant or U.S. Pat. No. 3,631,970 to Trauschke. These configurations do not lend themselves to automatic handling and loading. Another common method is to place the article on a display card and enclose it in plastic which grips the article and prevents it from rotating such as seen in U.S. Pat. No. 3,764,002 to Spiegel or U.S. Pat. No. 3,463,307 to Caplan. In addition, U.S. Pat. No. 3,542,282 to Troth teaches the use of foam elastomeric resin sheeting as a liner for a carton to provide cushioning and, at the same time, to prevent rotation.

SUMMARY OF THE INVENTION

A carton which may be either a one piece blank or assembled with an insert placed into a conventional rectangular display carton, wherein the insert or the interior structure is designed to restrain a cylindrical object to be contained there against a portion of the interior panels having a substance which is resilient at room temperature but not tacky and thereby frictionally engages the surface of the cylindrical object to prevent it from rotating within the carton.

DETAILED DESCRIPTION OF THE PREFERRED EMBODIMENT

Figure 1:
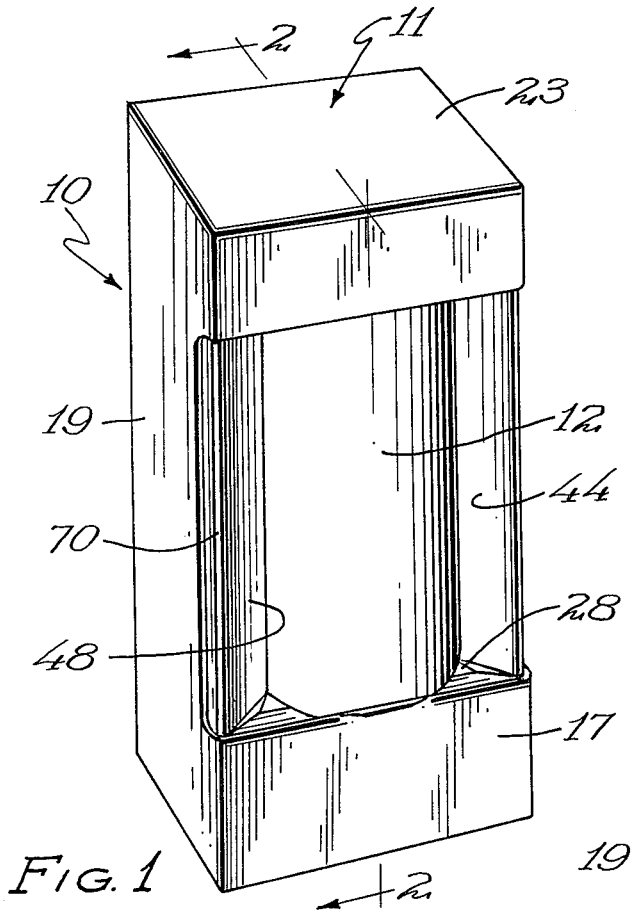
FIG. 1 is a perspective view of a carton embodying the present invention with a cylindrical article therein.

The package 10 is comprised of an outer rectangular display carton structure 11 designed to hold a cylindrical object 12. A first embodiment employs a one-piece blank 13 shown in FIG. 6 which is generally rectangular in shape with horizontal top and bottom edges and vertically aligned side edges. The blank 13 is divided into several side by side panels by vertically oriented fold lines and includes an outer back panel 14, a pair of outer side panels 15 and 16, disposed on either lateral edge of the back panel 14, and a front panel 17 having a display aperture 18 formed therein through which the contents may be viewed. These four panels along with a glue flap 19 form the outer structure of the carton 11. In addition there are closure flaps provided on the top and bottom of these four primary panels in the configuration shown including dust flaps 20 and 21 hingedly attached along the top edge 22 of the blank, as well as a large cover flap 23 similarly attached to the front panel 17. A similar configuration is hingedly attached along the bottom edge 24 and includes a pair of dust flaps 25 and 26 and a large cover flap 27. Formed as a part of the front panel 17 and extending into the aperture 18 is a support flap 28 on which the cylindrical object 12 is positioned and which will be described in more detail later.

Figure 3:
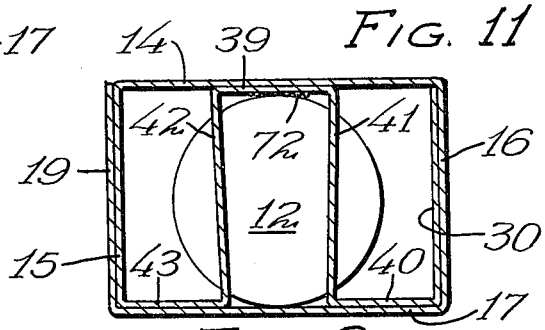
FIG. 3 is a sectional view taken along section lines 3—3 in FIG. 2.

The internal support structure in this embodiment is hingedly attached to the edge of the side wall 15 and includes an outer glue flap 30 which in its final folded position is adjacent the side wall 16. Positioned between this outer panel 30 and the side wall 15 is a nearly symetrical die cut section comprising a number of vertically oriented panels connected with score lines which folds into a generally U-shaped and box-like structure to support and engage the cylindrical object 12. Across the bottom of the section are four small portions of panels identified as 31, 32, 33 and 34 which are connected by vertically positioned score lines and are vertically defined by either the die cut areas 35 and 36 or line cuts 37 and 38. These four panels, in combination with the center section 39 form a five-sided U-shaped structure which appears in FIG. 5 but is somewhat obscured by the support panel 28. The configuration is similar to that which appears in FIG. 3 and illustrates the top edge of the blank which is defined by the four panels 40, 41, 42 and 43 similarly connected to each other and the center panel 39 by vertically oriented score lines. These upper and lower box-like sections serve to space the cylindrical article 12 from the top and bottom edges of the carton.

Between these groups of panels are six panels which in the final configuration present folded edges which contact the cylindrical article 12 along a vertical in front of its widest diameter and which tend to hold the cylindrical article 12 against the back center surface.

Figure 4:
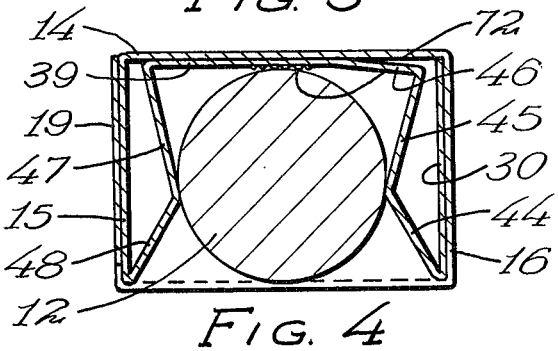
FIG. 4 is a sectional view taken along section lines 4—4 in FIG. 2.

It is on this central panel 39 that a pattern of hot melt adhesive or expanded foam coating is located which frictionally engages the surface of the article 12 and prevents it from rotating. The material should be one which has sufficient resiliency at room temperature to provide adequate friction with the surface of the article 12 but should not be one which is tacky and therefore would result in the folded blanks adhering to one another. These sections are labeled 44, 45, 46, 47 and 48. There is a lack of symetry in that there are three panels on the left side and only two on the right side of the center panel 39. The reason for that is to allow some flexibility in the structure when the article 12 is loaded into the carton as may be seen in FIG. 4. The score line between the panels 45 and 46 allow those panels to move inwardly and away from the article 12 while it is being loaded.

Figure 11:
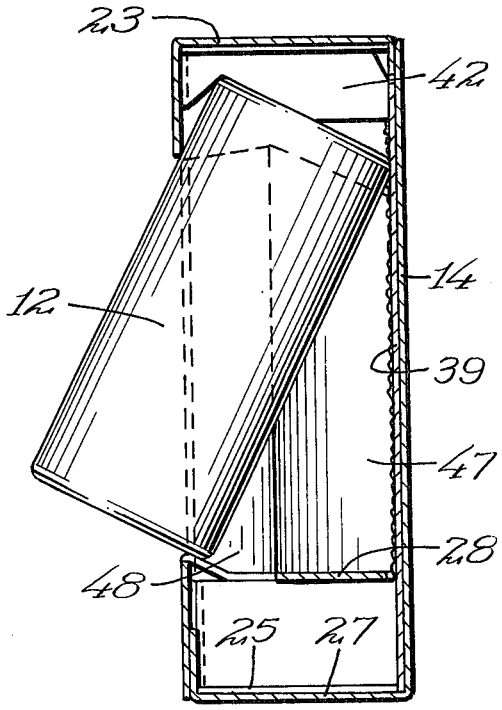
FIG. 11 is a side elevational section view of the carton of FIG. 1 illustrating how a cylindrical object is loaded into the carton from front.
Figure 2:
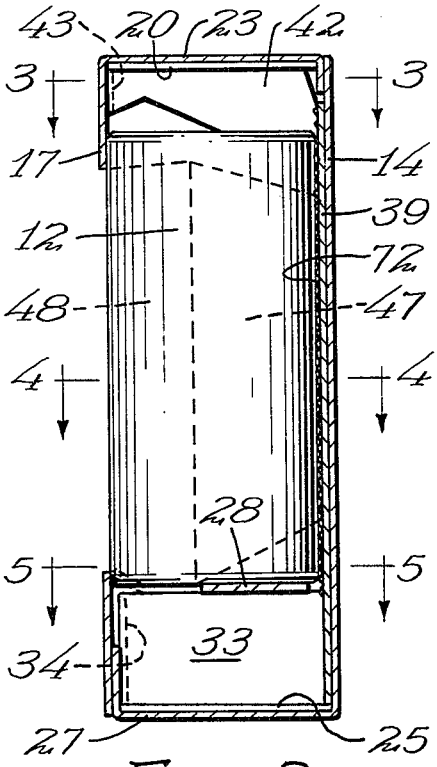
FIG. 2 is a side elevation sectional view of the carton and the cylindrical object shown in FIG. 1 taken along section lines 2—2.
Figure 5:
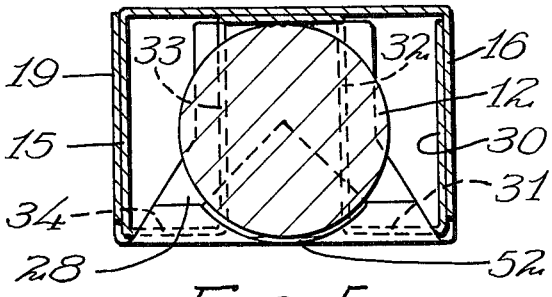
FIG. 5 is a sectional view taken along section line 5—5 in FIG. 2.

A particular note is the configuration of the die cut apertures 35, 36, 50 and 51. The horizontal edges on the apertures 35 and 36 work in combination with the inwardly foldable support platform 28 to provide a support for the bottom of the article 12 as seen in FIG. 5. The horizontal edges of the apertures 50 and 51 which are on the upper side of the aperture serve to engage the top of the article in its final position as seen in FIG. 2. The angled portions of the aperture on the upper surface allow the article 12 to be front end loaded after the carton is fully erected as seen in FIG. 11. The blank is die cut so that the distance between the horizontal surfaces is the exact height of the article 12. Similarly the geometry of the downwardly angled portion of the apertures 50 and 51 is spaced from the front lip of the small aperture 52 which is formed in the support flap 28 a distance exactly equal to the height of the article 12 as seen best in FIG. 11 to allow the article 12 to be at first positioned against the upper surface and then moved into the carton 11 by pushing the bottom of the article 12 into place.

Figure 6:
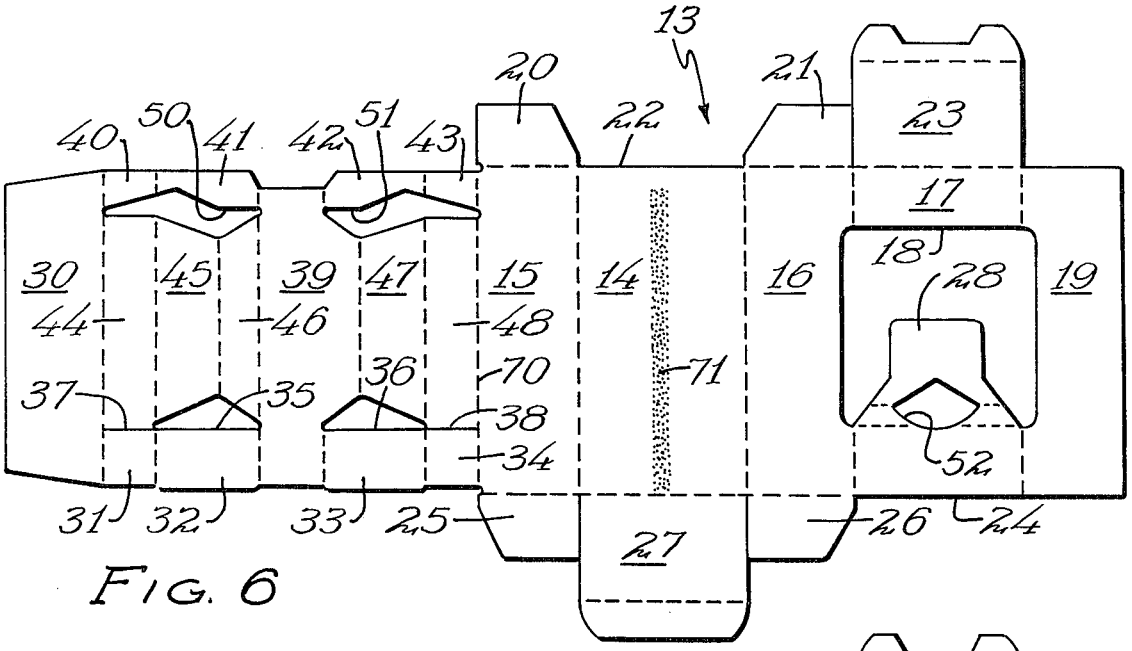
FIG. 6 is a plan view of the blank adapted to be folded into a carton similar to that shown in FIG. 1.
Figure 7:
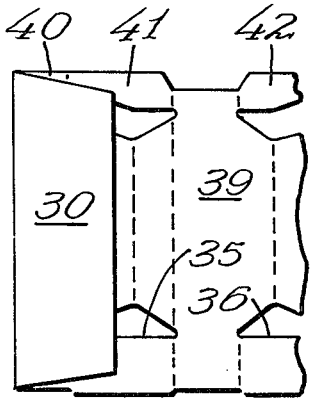
FIG. 7 illustrates a portion of the blank shown in FIG. 6 and illustrates the first step in the folding process.
Figure 8:
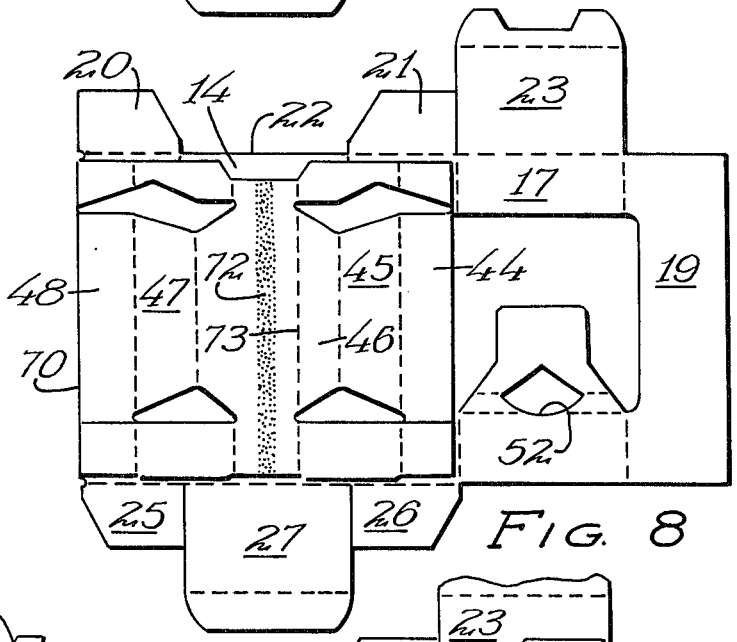
FIG. 8 illustrates the next sequential step in the folding of the blank.
Figure 9:
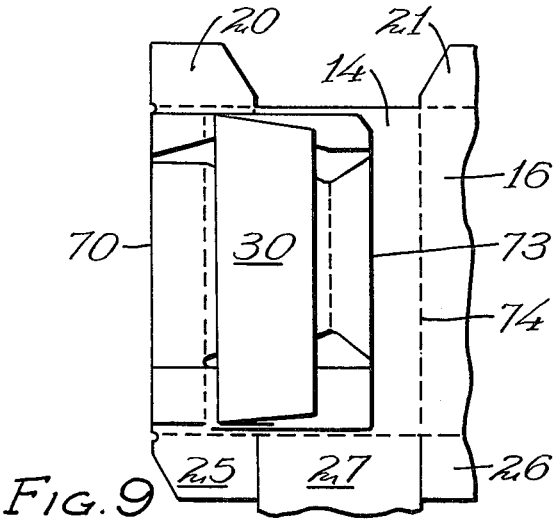
FIG. 9 illustrates the third folding step in the assembly of the blank.
Figure 10:
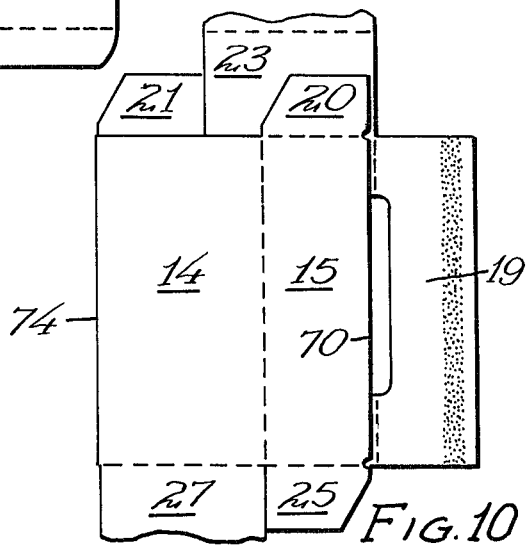
FIG. 10 illustrates the final or fourth fold to assemble the blank.

The carton blank is erected by a four-part folding sequence as illustrated in FIG. 7 through 10 and is initially begun by folding the flap 30 inwardly as seen in FIG. 7 and secondly, folding the entire interior section inwardly or to the right about the fold line 70. The section is held in place with the panel 39 adhesively attached to the back outer panel 14 by a line of adhesive identified in FIG. 6 as 71. The line of adhesive or other material as previously described 72 as shown in FIG. 8 is the material against which the article 12 contacts. As seen best in FIG. 9 the portion of the interior sections are folded back to the left about the fold line 73 and then the final step is for the front and side panels 17 and 16 to be folded to the left about the fold line 74 and the glue flap 19 adhesively attached to the outside of the side wall 15. This rather complicated folding procedure may nevertheless be accomplished on automatic equipment at high speeds. The carton then simply opens up to the configuration shown in FIGS. 1 through 5 and the end dust flaps may be put in place. The article 12 is then inserted through the opening in the front of the carton and it may be left as is and overwrapped with plastic film.

Figure 12:
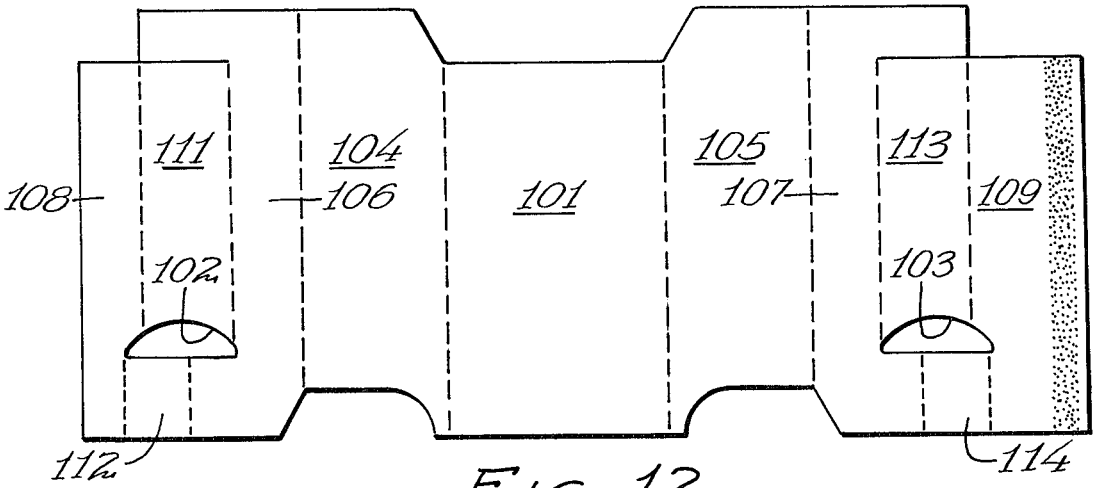
FIG. 12 is a plan view of a blank adapted to be erected into an insert for use in a two-piece embodyment of the present invention.

The alternate embodiment illustrated in FIGS. 12 through 16 is somewhat simpler in that the insert performs the function of the die cut sections on the blank in FIG. 6. Since the insert is placed into the carton after it is erected, the article 12 may be placed within the insert before it is placed into the carton and therefore the necessity for the restrictions relating to special dimensions in the die cut sections for purposes of loading the article 12 are not needed. The blank shown in FIG. 12 is therefore symetrical and is adpated to present two edges which extend the vertical length of the article 12 and position it beyond its midpoint to hold it against the adhesive pattern on the back panel of the blank. A blank illustrating the outer carton is not shown as it is a conventional style and would consist of that portion of the blank in FIG. 6 to the right hand side of the fold line 70.

Figure 13:
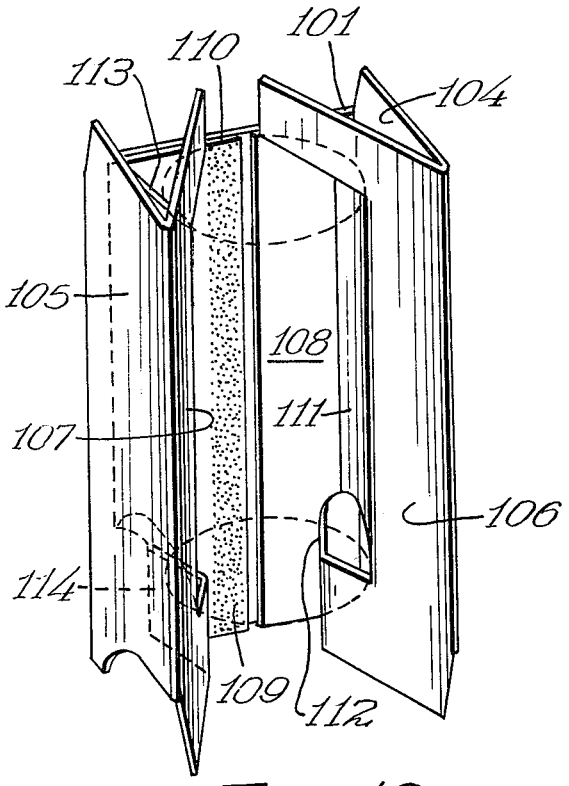
FIG. 13 is a perspective view of the insert of FIG. 12 illustrating its positioning and relationship to a cylindrical object to be placed therein.
Figure 14:
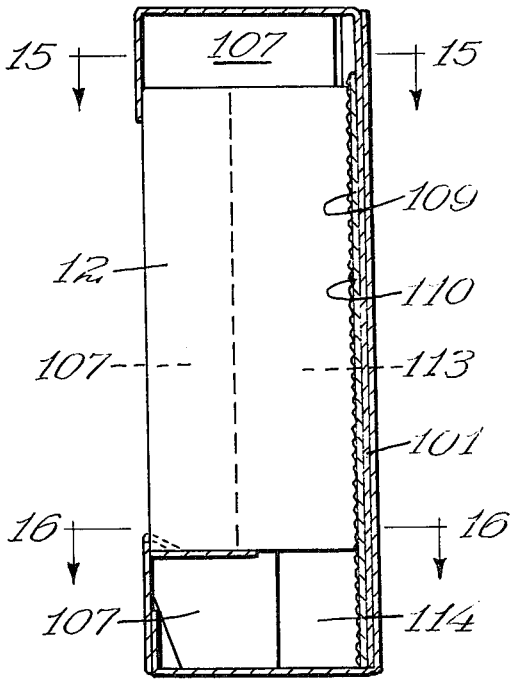
FIG. 14 is a side elevational section view of a carton similar to that shown in FIG. 1 but of the embodiment employing the insert of FIG. 13.
Figure 15:
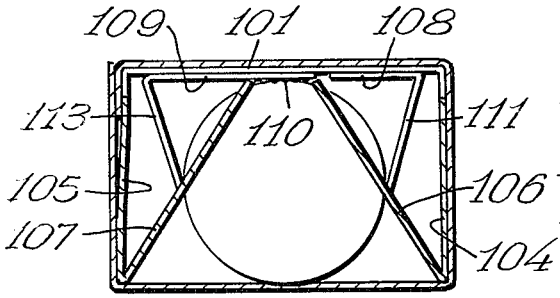
FIG. 15 is a sectional view taken along section lines 15—15 in FIG. 14.
Figure 16:
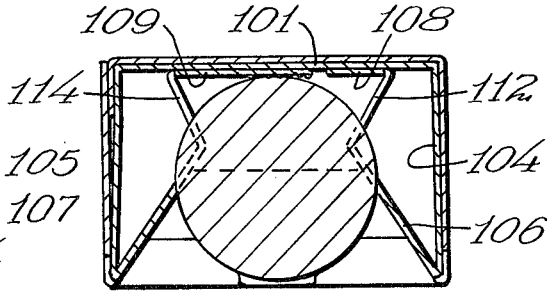
FIG. 16 is a sectional view taken along section lines 16—16 in FIG. 14.

The blank for the insert is shown in FIG. 12 and is substantially rectangular in shape having a central panel 101 which is rectangular and has hingedly attached to either side thereof a series of panels connected by vertical hinge lines which form a structure such as shown in FIG. 13 and is a basic right angle U-shaped structure with sections which extend diagonally across the area to restrain the top and bottom edges of the top of the article 12. Apertures 102 and 103 are formed near the bottom of the structure and have horizontal edges to support the bottom of the article 12. On either side of the panel 101 are side wall liner panels 104 and 105. On either side of the panel 101 are side wall liner panels 104 and 105 which lie at right angles to the central panel 101 inside the outer carton. The two sections which lie diagonally and are adjacent to the panels 104 and 105 are labeled 106 and 107 these diagonally oriented panels 106 and 107 are hingedly attached to the side wall liner panels 104 and 105 and have die cut sections which extend to contact the upper and lower surfaces of the article 12. Each diagonally oriented panel has attached thereto a foldable die cut section which includes an outer glued flap 108 and 109 which are folded into position against the exposed surface of the central panel 101 to hold the entire assembly together. It is on the exposed surface of the glue flap 109 that the hot melt adhesive or other coating is located which contacts the surface of the article 12 and as can be seen in FIG. 12 it is designated as 110. There are offset panels 111 and 112 as well as 113 and 114 which act as struts to position the glue flaps 108 and 109 against the back surface.

It should be understood that the particular folding sequence is not limited to that described, and may be reordered to conform with particular equipment. The final configuration must of course be retained.

What is claimed is:

1. A combination comprising: a rectangular display carton having a front and back panel, said front panel having an aperture formed therein to display the contents of said carton; and an insert adapted to contact and provide restraint for a smooth cylindrical object to prevent rotation thereof out of registration with said opening in said carton, said insert comprising a central panel, a series of at least three panels connected by parallel vertical hinge lines on each side of said central panel and elongated offset strut panels formed in the second of said series of panels, said strut panels having article engaging edges, and friction means applied to said inner surface of said central panel for contacting said cylindrical article to prevent rotation thereof.

2. The insert of claim 1 wherein said friction means is a pattern of applied hot melt adhesive having sufficient resiliency at room temperature to provide friction with the surface of said article.

3. A blank for a paperboard display carton with an interior structure adapted to receive and restrain movement of a smooth cylindrical article, said blank comprising:

a substantially rectangular piece of paperboard, the top and bottom edges thereof being defined by horizontal fold lines, and the lateral edges thereof being defined by vertically extending edges;

an outer back panel;

a pair of outer side panels connected along opposite lateral edges of said outer back panel along vertically extending parallel hinge lines;

a front panel connected along a vertical fold line to a first of said outer side panels, said front panel having formed therein a display aperture;

a narrow glue flap hingedly attached to said front panel along a vertically extending fold line;

an internal support structure hingedly attached along a vertical hinge line to a second of said outer side panels;

said internal support structure including a center section and a pair of die cut sections spaced on either side of said center section;

a first of said die cut sections connecting said second outer side panel with said center section consisting of two pairs of panels positioned near the top and bottom of said blank;

said pairs of panels each defined by parallel and colinear fold lines with a third pair of panels positioned intermediate and separated from said top and bottom pairs of panels with a hinge line connecting said center section being offset from the respective hinge line connecting said center section to said top and bottom pairs of panels;

the second die cut section including top and bottom pairs of panels defined by parallel and colinear fold lines with three intermediate panels connected to one another along vertical parallel fold lines and to an outer glue flap and said center section along vertical fold lines; and said sets of pairs of top and bottom panels and said sets of intermediate panels foldable to present exposed edges engagable along vertical lines with a cylindrical object.

* * * * *